United States Patent [19]

Grunewald

[11] Patent Number: 4,502,307

[45] Date of Patent: Mar. 5, 1985

[54] WIRE BENDING MACHINE

[76] Inventor: Rudolf Grunewald, Graf-Engelbert-Str. 12, 5657 Haan 1, Fed. Rep. of Germany

[21] Appl. No.: 466,615

[22] Filed: Feb. 15, 1983

[30] Foreign Application Priority Data

Feb. 18, 1982 [DE] Fed. Rep. of Germany ..... 3205740

[51] Int. Cl.[3] ..... B21C 31/00

[52] U.S. Cl. ..... 72/22; 72/453.02; 72/30

[58] Field of Search ..... 72/453.02, 453.01, 453.06, 72/453.08, 22, 23, 30; 140/105

[56] References Cited

U.S. PATENT DOCUMENTS

| | | | |
|---|---|---|---|
| 2,459,888 | 1/1949 | Lindsey | 72/453.08 |
| 3,633,395 | 1/1972 | Anderson | 72/22 |
| 3,730,313 | 5/1973 | Luenser | 72/22 |
| 4,116,122 | 9/1978 | Linder et al. | 72/453.01 |
| 4,152,921 | 5/1979 | Dits | 72/453.02 |
| 4,203,477 | 5/1980 | Bruller et al. | 140/105 |
| 4,366,689 | 1/1983 | Yajima | 72/23 |

FOREIGN PATENT DOCUMENTS

| | | | |
|---|---|---|---|
| 29223 | 5/1981 | European Pat. Off. | 72/453.08 |

*Primary Examiner*—Daniel C. Crane
*Attorney, Agent, or Firm*—Holman & Stern

[57] ABSTRACT

The invention relates to a wire bending machine which incorporates an hydraulically actuated bending tool-slide or pusher. According to this invention the total stroke of the pusher is subdivided into a plurality of discreet part-strokes. In particular, relatively different pressure values may be assigned to these discreet part strokes and preferably a separate hydraulic pump is provided for each pressure value. These provisions succeed in a highly economical manner in applying only such deformation forces as are actually required for the given operational stage or process within the total machine stroke. The hydraulic pump or pumps and associated pressure reservoir or reservoirs may therefore be optimally dimensioned at less cost.

11 Claims, 4 Drawing Figures

WIRE BENDING MACHINE

Figure 1:
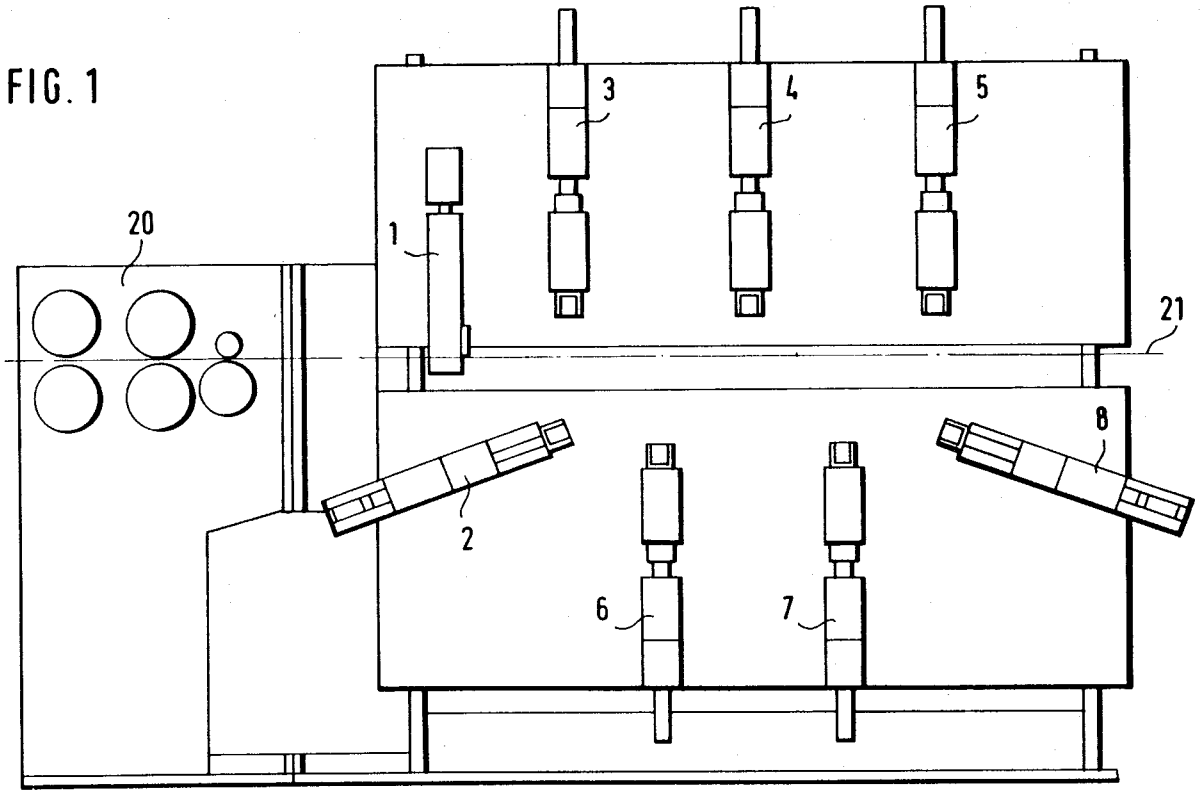

This invention relates to a wire bending machine of the kind having bending tool slides, or pushers which can be controlled by means of hydraulic cylinders in such a manner that highly complex wire shapes can be produced on a single machine with the aid of a correspondingly large number of such tool slides or pushers. The individually associated hydraulic cylinders of these pushers are conventionally controlled by means of cams mounted on a common camshaft, thus allowing preselection of the operational sequence in which the individual pushers are applied.

The hydraulic drive requires the provision of an hydraulic pump and of a pressure reservoir, both of which components must have sufficiently large dimensions to ensure that even at the end of a bending stroke hydraulic fluid can still be supplied to each hydraulic cylinder at a pressure which is high enough to provide an adequately strong bending force. For this reason either the pressure reservoir must be correspondingly large, or the hydraulic pump itself must be a very large pump. The operative movements of the tool which is involved in each bending stroke will then, if applied with correspondingly high kinetic energy to the respective wire section, generate very loud impact noises or knocking which creates an environmental nuisance of considerable magnitude.

Starting with this state of the art the present invention sets out to design a wire bending machine in such a manner that the hydraulic pump—or where provided—several pumps—and/or the pressure reservoir or reservoirs associated therewith can be constructed considerably smaller than heretofore. Moreover, it is desirable that the noise which is generated by the new wire bending machine shall be substantially reduced by comparison with hitherto known wire bending machines.

According to this invention the total operational stroke is resolved into at least two discrete strokes in the interval between which sufficient pressure can build up each time in the pressure reservoir to enable the subsequent part-stroke to be performed.

In the same way the arrangement according to this invention allows the splitting up of the total stroke—which may also include the idle motion up to the point of operative engagement with the wire—in such a way that differential pressure values can be associated with the individual part-strokes so as to enable application of pressure from several hydraulic pumps. In that case, for example, the idle motion stroke may be executed under very low pressure from an hydraulic pump which is specifically assigned to this task whereupon the actual bending stroke may be executed under the pressure of a substantially more powerful hydraulic pump. The advantage in each case resides in that the impact force under which the tools make contact with the wire can be reduced to correspond to the given length of idle motion travel thus achieving a significant noise reduction. For the ensuing further part-stroke or strokes the bending tool is already in contact with the wire so that no impact noises can be caused by the release of the following part-stroke or strokes.

Conveniently the periods of dwell between successive part-strokes are controlled by timing circuits which, as such, are not generally used in machines which are controlled in accordance with tool travel distances.

Furthermore, with short part-strokes the bending machine can be operated at a very high pusher speed, notably at a speed in excess of 1.6 m/s. The slowing down effect or speed-drop which occurs in long travel strokes during the last part of the stroke is prevented by the present invention.

With special advantage the hydraulic cylinders for the pusher tools in the new bending machine will be numerically controlled. This enables the preselection of rated values, times and even complete bending programmes with the aid of a programmer unit, virtually free of timeloss or delays.

For this kind of control system the hydraulic cylinders and/or the bending tools or pushers are provided with displacement pick-ups so that via their answer-signal to a comparator a closed control loop circuit is set up which is effectively governed by the respective preselected rated value. The drive of the hydraulic cylinders remains switched on for as long as there is a shortfall in respect of this rated value and when this value is actually reached the drive of the hydraulic cylinders is switched off, in particular by closing a valve in the hydraulic circuit.

According to a further development of the invention the differential part-strokes are released, or triggered by means of timing generators. These timing generators may be set, for example, to values which are guaranteed to be sufficiently high to ensure that a predetermined pressure has built up in the pressure reservoir of the hydraulic pump between two successive part-strokes. This guarantees that a sufficiently high pressure is available for each and every movement of the bending machine.

In modification of this principle the timing generator may also be controlled by means of a pressure signal from the pressure reservoir so that the next time signal for switching the hydraulic cylinders on will occur in the time needed by the pressure reservoir to restore its predetermined pressure level.

Figure 2:
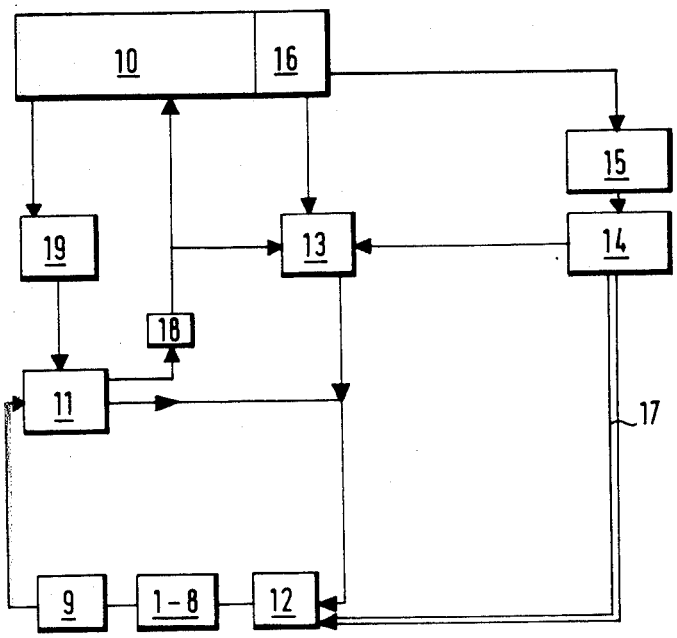

The invention is further illustrated and described with reference to the accompanying schematic drawings which concern one example of an embodiment and in which FIG. 1 shows a wire bending machine in side elevation whilst FIG. 2 illustrates the control system of the wire bending machine and FIGS. 3 and 4 relate to details of the control system.

The wire bending machine according to FIG. 1 is preceded by a wire feed device (20) which enables intermittent advancement of a wire section. In this way a given wire section can pass through the working zone which is defined by a plurality of bending tools or pushers (1 to 8) and be subjected to bending deformation in the region of each of said tools (1 to 8). The horizontal line (21) shown in dots-and-dashes indicate the path which the wire would travel if no deformation were applied thereto. The individual pushers (1 to 8) are selectively adjustable in such a way as to allow the wire to be bent to a desired shape or configuration. A wire bending machine of this kind is conventionally controlled by means of cams associated with the pushers in such a way that each pusher executes a stroke or travel corresponding to its position. This arrangement requires the earlier mentioned correspondingly large constructional dimensions for the hydraulic pump and/or the pressure reservoir and also entails a very high degree of loud noise nuisance.

The control system of the wire bending machine according to FIG. 2 eliminates these disadvantages. Please note that FIG. 2 shows only that part of the control system which relates to the right hand side of the machine. The programmer (10) is adapted to receive a bending programme, e.g. as recorded on a punch card or on punched tape, and, besides having the inputs and outputs shown in the drawing it also has at least one further output for the wire-feed device (20). Once the selected programme is fed into the programmer the subsequent operational cycle of the machine is triggered by actuation of the switch (16). Actuation of this switch (16) first of all starts the hydraulic pump (15) which pumps hydraulic fluid to the pressure reservoir (14). From there a pressure-reflecting signal is sent to the timing generator (13) whilst at the same time fluid under pressure flows through the connection shown in double lines (17) to the drive (12) at which point, however, it is still held back for the present by means of a valve. Actuation of switch (16) also starts or activates the timing generator (13). However, the timing pulse which may issue from the timing generator (13) cannot be transmitted further before either a certain minimum time lapse or before the arrival of a signal from reservoir (14) confirming the actual achievement of a predetermined pressure in said reservoir (14). Furthermore, the timing generator (13) must also receive a signal from clearing block (18) permitting the further transmission of a timing pulse only if the machine drive (12) has stopped. These provisions prevent the premature start-up of the drive whilst the latter may still be occupied with the preceding bending operation.

The programmer (10) provides the respective theoretical or rated value for rated value signal (19). The issue of this rated value signal at the start of a bending programme for the first operational step of this programme does not depend on any condition or parameter whereas all the other part-strokes in a total stroke can receive a rated value signal only after the clearing block (18) has issued a signal to programmer (10) signifying that the preceding operation has been completed, in other words, that the drive (12) has stopped.

The rated value signal is eventually applied to the comparator (11). The comparator (11) also receives a stroke or travel signal from the travel pick-up (9) so that it can determine whether or not the distance covered by a part-stroke agrees with the rated value. For as long as there is a shortfall a signal is applied by comparator (11) to the drive (12) and maintains this drive switched on until actually picked up value agrees with rated or preset value. During this phase one of the pushers (1 to 8) is engaged by the drive (12). The drive (12) is merely schematically and very simply represented in FIG. 2. The control system is appropriately differentiated to correspond to the number of hydraulic cylinders for the individual pusher tools.

The provision of the individual circuit blocks ensures that the programmer (10) will provide a rated value for stroke travel for each individual part-stroke. It also ensures that the drive (12) can only be switched on when—assuming previous actuation of starter switch (16)—pressure in reservoir (14) is sufficiently high and a switch-off has gone before.

By means of the programmer (10) the invention enables a very precise preselection of stroke lengths without creating unnecessary idle motion travel in the individual strokes. Results achieved in operation with an accuracy of 0.1 mm can be subjected to effective correction by creating intervention facilities in the programmer. Since the wire has actual contact with the pusher tools the latter may also be used as wire guides for preceding sections. The short part-strokes guarantee constant bending forces in their particular region.

The timing generator (13) may also react to a travel-signal of the pusher tool in such a way that the next following timing pulse for the next stroke is triggered only when the predetermined length of travel has been completed and at the same time the preselected pressure has been established. As already mentioned differential pressure values may be associated with the individual strokes in a highly attractive manner so that respectively highest pushing force of the tools need be applied only when the bending operation concerned actually requires such high bending force.

In the most simple embodiment of the invention two individual part-strokes are provided, the first of which involves idle motion which is then followed by the actual bending stroke. The idle motion stroke is executed under substantially lower pressure than the bending stroke which affords a significant saving.

In practice the provision of two or more hydraulic pumps for relatively different pressures is of considerable importance. The lowest hydraulic pressure will then be associated with idle motion whereas the subsequent part-strokes or strokes will be executed under high pressure.

Figure 3:
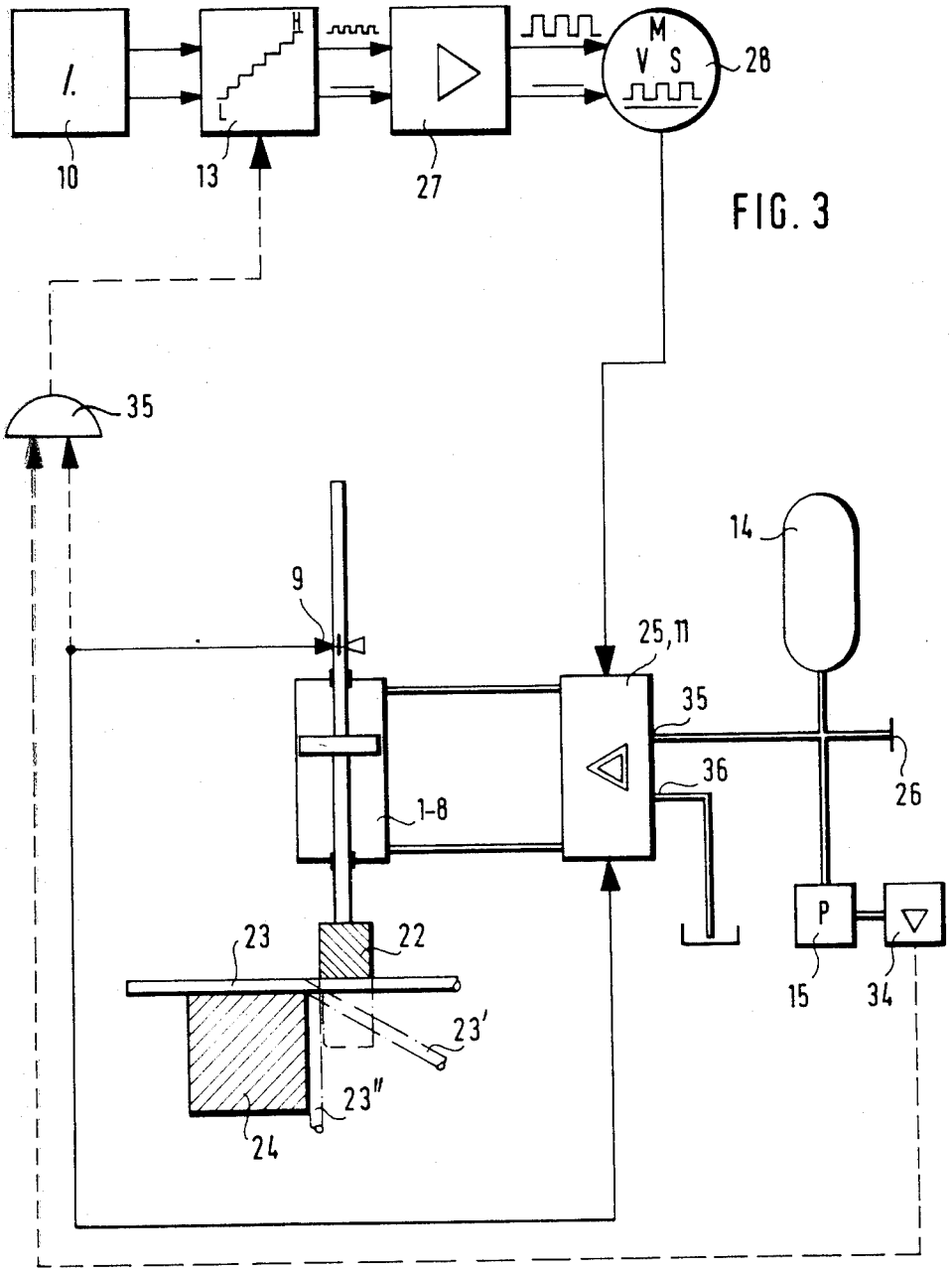

The schematic representation shown in FIG. 3 reveals details of the control system. The wire (23) is here bent by tool (22) on one of the pushers 1–8 at right angles across a tool plate (24). The drawing illustrates, corresponding to the relatively different operative strokes executed by the pusher, a first position (23') as well as a second position (23'') in which the wire is represented in dot-and-dash-lines. In other words, it occupies its final position only after the third operative tool stroke.

The pusher 1–8 is subject to a force applied thereto by means of an hydraulic fluid through an NC valve (25) which at the same time fulfills the function of the comparator (11). This NC valve (25,11) is a product of the firm Hartmann & Lammle, Type SVEZ 169, currently available on the market. This valve is actuated or driven by a stepping motor (28).

Considered in detail, the programmer (10), besides switching on the hydraulic pump (15) by means not here shown, causes activation of the timing generator (13) either by means of a zero signal or by means of a work signal. The latter may be at different stop heights as indicated by the stepped line in (13). The signals are amplified in an amplifier (27) and then applied to the stepping motor (28) which actuates the NV-valve (25,11).

A pressure line leads from the hydraulic pump (15) to the pressure reservoir (14) in which the pressure level is monitored by the pressure pick-up (34). The pressure connection to the NC-valve (25,11) is indicated at (35) whilst the connection which is not under pressure (36) leeds into the pump sump. The NC valve is further adjusted by means of the rated value furnished by programmer (10). The travel-pick-up (9) of the pusher 1–8 also feeds into the NC-valve (25,11) so that the latter can make a comparison between rated and actual signal values.

The signal of the travel pick-up (9) is also transmitted to an AND gate (35) which has a second input from the pressure pick-up (34). However, the two last mentioned inputs are optionally selectable and the same applies in respect of the connection of the AND gate (35) to the timing generator (13) which in the event of such connection being made in the earlier described manner will be activated only when the travel executed by the pusher and also the pressure built up in reservoir (14) correspond to the respective predetermined values. Again optionally only one of the two signals, that is to say, either travel or pressure, may be used to activate the timing generator (13).

Figure 4:
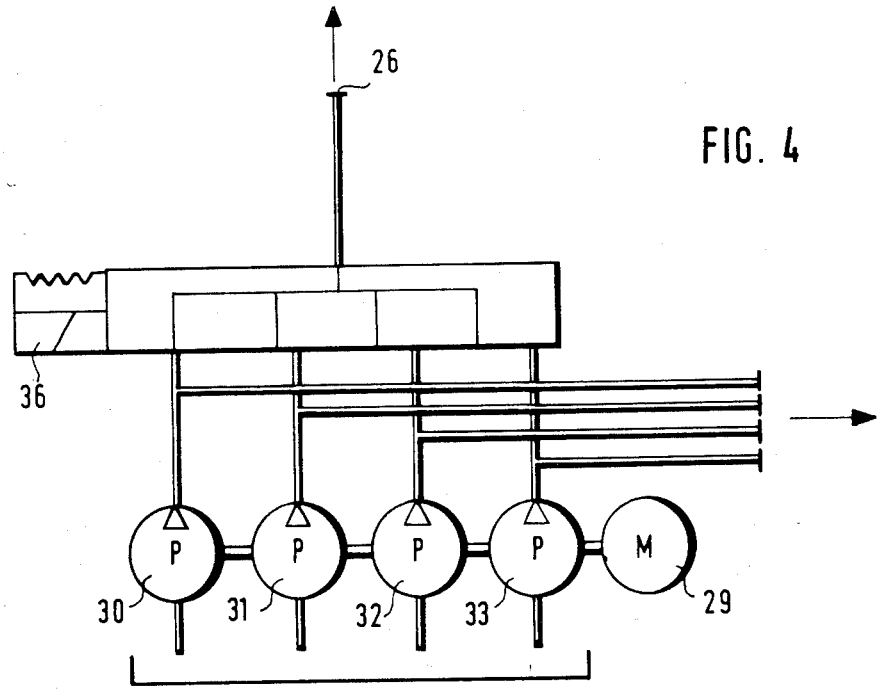

The allocation of differential pressure values for the individual part-strokes of a bending pusher can be arranged as shown in FIG. 4. In this particular case discreet pumps (30), (31), (32) and (33) are driven by a motor (29), each pump generating a different hydraulic fluid pressure. The pump outputs lead to a servo slide valve (36) which is actuable in a manner not particularly shown by programmer (10). Accordingly only one at a time of pumps (30) to (33) will come into communication with the connection (26) which in turn communicates with the corresponding connection (26) in FIG. 3.

The aforesaid arrangement is provided in multiples, as is also that of FIG. 3. This is illustrated by the various lines which branch off at the connections of pumps (30), (31), (32), (33).

I claim:

1. A wire bending machine for bending an intermittently advancing wire to a predetermined configuration comprising hydraulically driven, controlled bending tool slides or pushers, a hydraulic pump, a pressure reservoir and a valve comparator operatively connected to numerically controlled hydraulic cylinders of the bending tool slides, and having a control system for controlling the bending tool slides so that total tool stroke needed for bending a given wire section is subdivided into several discreet part-strokes with a dwell between successive part-strokes and a return stroke of the tool is effected at the end of the bending operation wherein the hydraulic cylinders or bending tool slides are equipped with travel-pick-ups, the signals of which are compared with preselected rated values in said comparator of the control system so that the drive of the hydraulic cylinders remains switched on up to the moment when the rated value is reached.

2. A wire bending machine according to claim 1, wherein the periods of dwell between the discreet part-strokes are controllable.

3. A wire bending machine according to claim 1, wherein the bending tool slides are adapted to be controlled at a high tool speed in excess of 1.6 m/s.

4. A wire bending machine according to claim 3, wherein the control system is further provided with timing generators for the correct adjustment of the intervals between two successive part-strokes.

5. A wire bending machine according to claim 4, wherein the timing generators can be set to data corresponding to the rise of pressure in the pressure reservoir of the hydraulic pump up to a preselected rated value.

6. A wire bending machine according to claim 4, wherein a pressure signal of the pressure reservoir is applied to the timing generators in such a manner that the respectively next following timing pulse is triggered at the moment when the preselected rated pressure value is reached.

7. A wire bending machine according to claim 4, characterised in that a signal reflecting completed travel of the tool-slides is applied to the timing generators in such a manner that the respectively next following timing pulse is triggered on achievement of the rated values for tool travel and for pressure.

8. A wire bending machine according to claim 7 wherein differential pressure values are assigned to the individual part-strokes.

9. A wire bending machine according to claim 8, wherein two discreet part-strokes in all are provided, the first of which is executed at low pressure starting with the start position of the tool slides and terminating with the achievement of mutual contact between the bending tools and the wire, and that the subsequent part-stroke is executed at increased pressure along the bending trajectory of the wire section.

10. A wire bending machine according to claim 9, further comprising two hydraulic pumps for pressures of relatively different values, one of said pumps being associated with the subsequent part-stroke executed at higher pressure.

11. A wire bending machine according to claim 9, wherein differential pressures are associated with the several part-strokes which make up the total bending stroke, with a separate hydraulic pump being provided for each of said differential pressures.

* * * * *